US012728342B2

(12) United States Patent
Shute

(10) Patent No.: US 12,728,342 B2
(45) Date of Patent: Sep. 8, 2026

(54) SKI BINDING HEEL UNIT

(71) Applicant: Cameron Allan Shute, Nelson (CA)

(72) Inventor: Cameron Allan Shute, Nelson (CA)

( * ) Notice: Subject to any disclaimer, the term of this patent is extended or adjusted under 35 U.S.C. 154(b) by 309 days.

(21) Appl. No.: 18/610,496

(22) Filed: Mar. 20, 2024

(65) Prior Publication Data

US 2024/0325864 A1 Oct. 3, 2024

Related U.S. Application Data

(60) Provisional application No. 63/456,466, filed on Apr. 1, 2023.

(51) Int. Cl.
*A63C 9/08* (2012.01)

(52) U.S. Cl.
CPC ..... *A63C 9/0805* (2013.01)

(58) Field of Classification Search
CPC ... A63C 9/0805; A63C 9/0807; A63C 9/0843; A63C 9/0844; A63C 9/08564; A63C 9/08578; A63C 9/08585; A63C 9/086; A63C 9/006
See application file for complete search history.

(56) References Cited

U.S. PATENT DOCUMENTS

| | | | | |
|---|---|---|---|---|
| 8,746,728 | B2 * | 6/2014 | Shute | A63C 9/0846 280/607 |
| 9,463,370 | B2 * | 10/2016 | Howell | A63C 9/0844 |
| 10,010,782 | B2 | 7/2018 | Damiani | |
| 10,315,099 | B2 * | 6/2019 | Shute | A63C 9/0848 |
| 10,463,946 | B2 * | 11/2019 | Shute | A63C 9/005 |

FOREIGN PATENT DOCUMENTS

| | | | | |
|---|---|---|---|---|
| AT | 402020 | | 1/1997 | |
| AT | 402020 | B * | 1/1997 | A63C 9/086 |
| DE | 102013224574 | A1 * | 6/2015 | A63C 9/0843 |
| DE | 202015005560 | | 11/2016 | |
| EP | 0199098 | | 2/1990 | |
| EP | 0519243 | | 4/1995 | |
| EP | 1559457 | | 9/2007 | |
| EP | 2545966 | A2 * | 1/2013 | A63C 9/0846 |
| EP | 2345462 | | 8/2013 | |

(Continued)

*Primary Examiner* — Steve Clemmons
(74) *Attorney, Agent, or Firm* — Kyle R. Satterthwaite; Ryan W Dupuis; Ade & Company Inc.

(57) ABSTRACT

A heel unit apparatus for a ski touring binding features two separate heel pins projecting forwardly from a heel body, and a heel pin blocker engaging the heel pins at an adjustable location within lengthwise mid regions thereof to laterally restrain outward spreading of the heel pins at said location. A blocker adjustment is operable to vary location of the blocker. Rear regions of the heel pins are restrained against longitudinal and lateral displacement. Lateral outward spreading of the heel pins in front of the heel body during both forced insertion of a footwear heel and safety release thereof is achieved by laterally outward flexure of the heel pins themselves. The adjustable location of the blocker varies the resistance to such spreading, thus setting the effective spring stiffness of the heel unit, and thereby dictating the spreading force needed to spread the heel pins apart during footwear insertion and release.

10 Claims, 6 Drawing Sheets

(56) References Cited

FOREIGN PATENT DOCUMENTS

| | | | | |
|---|---|---|---|---|
| EP | 3050602 | | 8/2016 | |
| EP | 3050602 | A1 * | 8/2016 | ..... A63C 9/086 |
| EP | 3345659 | A1 * | 7/2018 | ..... A63C 9/0807 |
| EP | 3581248 | A1 * | 12/2019 | ..... A63C 9/0846 |
| EP | 4112140 | | 1/2023 | |
| EP | 4147757 | A1 * | 3/2023 | ..... A63C 9/086 |
| EP | 3906980 | | 1/2025 | |
| EP | 4272845 | | 9/2025 | |
| EP | 4272846 | | 3/2026 | |
| EP | 4272847 | | 4/2026 | |
| WO | WO-2012024809 | A1 * | 3/2012 | ..... A63C 9/08528 |

* cited by examiner

SKI BINDING HEEL UNIT

CROSS REFERENCE TO RELATED APPLICATIONS

This application claims benefit under 35 U.S.C. 119(e) of U.S. Provisional Patent Application No. 63/456,466, filed Apr. 1, 2023, the entirety of which is incorporated herein by reference.

FIELD OF THE INVENTION

This invention relates to the toe unit of release bindings used in alpine ski touring, also known as "AT bindings". More particularly, this invention relates to such heel units which engage with the footwear for skiing and support the heel with adjustable risers for ski touring.

BACKGROUND OF THE INVENTION

Alpine touring bindings allow the heel of the user's footwear (such as a ski boot) to be latched to a snow travel aid (such as a ski), for sliding downhill (the "downhill mode") and allow the heel to be released for walking and climbing (the "touring mode"). Release bindings allow the footwear to release from the snow travel aid when in the downhill mode, in case of a fall. When in the touring mode, the user may climb or walk with a great degree of freedom since the footwear is pivotally engaged with the aid near the toe of the footwear while the heel of the footwear is free to move upward and downward relative to the aid. A historical collection of such bindings can be viewed in the "Virtual Museum of Backcountry Skiing Bindings" at www.wildsnow.com, authored by Louis Dawson.

Alpine touring bindings that take advantage of the fact that modern alpine touring boots have a rigid sole are called "pin bindings". With pin bindings it is unnecessary to provide a bar, plate or other arrangement connecting the toe and heel units, as is the case with many other alpine touring bindings (see patent publications EP0199098, EP0519243, EP1559457, and AT402020). Unlike other release bindings, lateral release of pin bindings is provided at the heel, not the toe.

Pin binding systems comprises a toe unit which has a set of jaws that pivotally engage a special insert in the footwear sole. The toe unit is mountable at an appropriate location on the upper surface of a snow travel aid. A separate heel unit is mountable at a particular region on the upper surface rearward of the toe unit, the location of which is dictated by the length of the footwear sole. The toe and heel units function independently in retaining the footwear attached to the snow travel aid. The heel unit comprises projections (typically a pair of pins) which extend forward to engage opposite sides of a fitting placed over a cavity in the rear of the footwear heel. Under forward release conditions, the pins are intended to be forced apart against spring pressure to respective release positions to disengage from the fitting and the heel. The pins typically communicate with a spring or springs through inclined sliding surfaces that move a block which engages the spring or springs. The original method of creating the spring pressure for the pins is to embody the two pins in a singular u-shaped spring, examples of which can be seen in EP0199098, DE202015005560, EP3050602 and EP4112140. Bindings of this type that make use of a u-shaped spring will be called "u-spring bindings." They typically work by having the u-spring handle the forward falling portion of release which retains the footwear heel vertically when skiing, while the lateral or twist release portion of the release is handled by one or more springs that are either horizontally mounted springs (EP0199098 and DE202015005560) or vertically mounted springs (EP3050602 and EP4112140). In both of the aforementioned binding types the springs providing the lateral release biasing action both push on a plunger which slides against a cam surface to provide this biasing action.

U.S. Pat. No. 10,010,782 describes a u-spring type pin binding where the u-spring biases the heel for both the forward falling and the lateral release modes. When twisting the heel unit about a vertical axis, two vertically mounted pins force the u-spring to open, which biases the heel unit towards a central skiing position.

The main advantage of the "u-spring" bindings is that they are mechanically simple, lightweight and inexpensive to manufacture. They are popular with dedicated ski tourers and ski mountaineers who seek to find a binding with the most minimal weight. U-spring bindings have the disadvantages of being set for only a single release value and they are subject to wear since the heel fittings rub the u-spring ends under high load with every engagement and vertical release of footwear for skiing. This results in a binding that is not possible to adjust the release forces to recommended values for based on the skier's size and weight without disassembling the binding, and switching out the u-spring for one with a different opening stiffness. Since many of the skiers who use these bindings are more interested in saving weight than the safety function of the bindings, they typically make this compromise.

U.S. Pat. No. 10,463,946 describes a binding where the u-spring is replaced by two independent pins that are able to rotate about their long axis and are biased against opening under the force of the footwear heel insert by a set of springs. This design allows the release value to be adjusted by means of adjusting the preload of the springs, and it also prevents the wear mentioned above that's associated with the u-spring bindings since the heel pins can rotate when the footwear heel is engaged with the binding, which prevents sliding wear under high load. The disadvantage of this type of binding is that it is much more complex, involves more moving parts, and is significantly heavier than u-spring bindings.

One attempt to make u-spring bindings adjustable has been shown in the KREUZSPITZE GT 2.0 binding (described here https://www.wildsnow.com/33339/kreuzspitze-gt-2-0-binding-a-first-look/), whose mechanism also appears to be present in EP3906980. The heel pin ends that engage with the footwear are cylindrical pins with holes inside them, and a u-spring element whose position can be adjusted fore and aft is inserted into the rear end of each heel pin. This provides a simple u-spring style binding that has adjustable release by way of changing the mechanical advantage of the u-spring by adjusting its position relative to heel pins. The disadvantage of this system is that the heel pins tips need to be retained inside the heel unit so they do not slip fore and aft but can move side to side.

SUMMARY OF THE INVENTION

Given the above summarized state of the art, one object of the present invention is to make lightweight ski binding heel units release settings easily adjustable.

Another object of the present invention is to make lightweight ski binding heel units heel pins more durable than u-spring bindings.

Another object of the present invention is to provide a means of making u-spring bindings designs adjustable and more durable by swapping out the u-spring for two separate heel pins with a means of adjusting an effective spring action of those pins.

Among preferred embodiments of this invention are novel design elements that, alone or in combination may denote, or contribute to, fulfillment of one or more of the foregoing objects of the invention, and in doing so, individually or collectively achieve an improved ski binding heel unit that is simple to manufacture, lightweight, has adjustable release settings, and is more durable that u-spring bindings. In one particularly beneficial embodiment of the present invention, a ski binding heel unit for a pin binding has two independent heel pins that are rotatable along their long axis, and are held at the appropriate width for engaging the footwear heel fitting by a blocking element located at a variable position along the length of the heel pins, which position can be adjusted fore and aft by way of an adjustment, such as an adjustment screw. The rear ends of the heel pins are fixed pivotally to allow rotation along their long axis as well as lateral rotation about a vertical axis, but restrained against longitudinal or lateral displacement. When the heel fitting is forced in-between the two heel pins, the heel pins themselves provide a biasing by each flexing outward at the frontmost heel pin tip, while being laterally restrained at the width of the blocking element. By adjusting the position of the blocking element towards the front of the binding unit, the release value will increase due to the shortening of the flexible front region of the heel pin, denoting a stiffening of the effective spring cooperatively embodied by the two pins. Conversely, if the blocking element is adjusted towards the rear of the heel unit, it softens the heel pin opening force due to the longer flexible front region and the increase in mechanical advantage. The blocking element only prevents the heel pins from opening (spreading) outwardly at the location of the blocking element, without detriment to a freely rotatable character of the pins along their long axes in their passage through the blocking element. The advantageous design is lightweight and simple, yet adjustable and durable. It's possible to utilize an arrangement like this to replace the "u-spring" in heel units that previously utilized such u-springs.

According to one aspect of the invention, there is provided a heel unit apparatus for a ski touring binding, the apparatus comprising:

a heel body;

two separate heel pins supported on said heel body in positions projecting forwardly from a front end of said heel body in positions of laterally spaced relation to one another, each one of said two separate heel pins having respective front and rear terminal ends of opposing relationship in lengthwise relation to the two separate heel pins;

a heel pin blocker engaging the two separate heel pins at an adjustable location within lengthwise mid regions of the two separate heel pins in a manner blocking laterally outward spreading of the two separate heel pins at said location;

a blocker adjustment operable to vary said adjustable location at which said heel pin blocker engages the two separate heel pins, and to hold the heel pin blocker static at said adjustable location, once set; and a rear heel pin holder by which the two separate heel pins, at rear regions thereof adjacent the respective rear ends of the two separate, are:

held fixed against longitudinal movement of either of the two separate heel pins;

held fixed against lateral displacement of either of the two separate heel pins;

held at a fixed lateral distance from one another; and allowed to spin about respective longitudinal axes of the two separate heel pin;

whereby, owing to lateral fixation and blocking of the two separate heel pins at both the rear and intermediate regions thereof, laterally outward spreading of the two separate heel pins at front regions thereof situated in front of the heel body during forced insertion of a footwear heel between said two separate heel pins for engagement thereby, and during safety release of the footwear heel therefrom, is achieved purely by temporary outward flexure of the two separate heel pins themselves, and closure of the front regions of the two separate heel pins back toward one another is effected purely by self-relaxion of the temporary flexure thereof.

According to another aspect of the invention, there is provided a heel unit apparatus for a ski touring binding, the apparatus comprising:

a heel post;

a heel body rotatable about said heel post;

two heel pins supported on said heel body in positions projecting forwardly from a front end of said heel body in positions of laterally spaced relation to one another;

a heel pin blocker engaging the two heel pins at an adjustable location within lengthwise mid regions of the two heel pins in a manner restraining laterally outward spreading of the heel pins at said location;

a blocker adjustment operable to vary said adjustable location at which said blocking element engages the two heel pins to adjust an effective spring stiffness of said two heel pins;

a set of contacts supported on the heel post in static relation thereto in positions that reside between the two heel pins and impart and outward spreading action thereto under rotation of the heel body in either direction out of a centered position in which the heel pins point longitudinally forward;

whereby the effective spring stiffness imparted to the two heel pins according to the adjustable location of the blocker controls both a forward falling release force required to spread the heel pins apart in the centered position, and a lateral release force required to rotate the heel body out of the centered position.

The above and other objects, aspects, features and advantages of the invention will become apparent from a consideration of the subsequent detailed description presented in connection with the accompanying drawings.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are particularly described, pointed out, and taught in the written descriptions. Some structural and operational aspects may be even better understood by referencing the written portions together with the accompanying drawings, of which.

DETAILED DESCRIPTION OF PARTICULAR EMBODIMENTS OF THE INVENTION

Aspects of the present disclosure are not limited to the exemplary structural details and component arrangements described in this description and shown in the accompanying drawings. Many aspects of this disclosure may be applicable to other aspects and/or capable of being practiced or carried out in various variants of use, including the examples described herein.

Throughout the written descriptions, specific details are set forth in order to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

Figure 1:
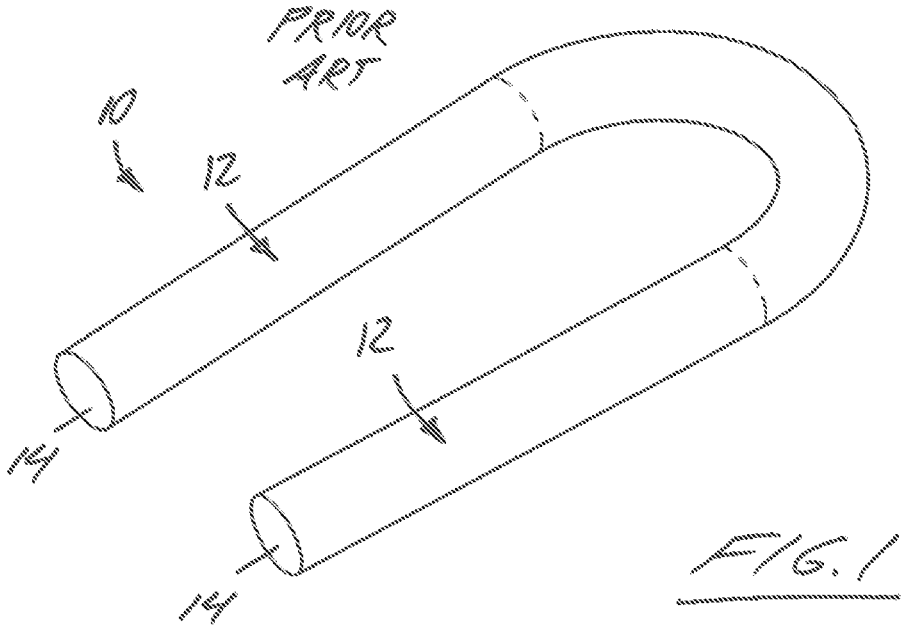
FIG. 1 is a front perspective view of a prior art u-spring heel pin arrangement.
Figure 2:
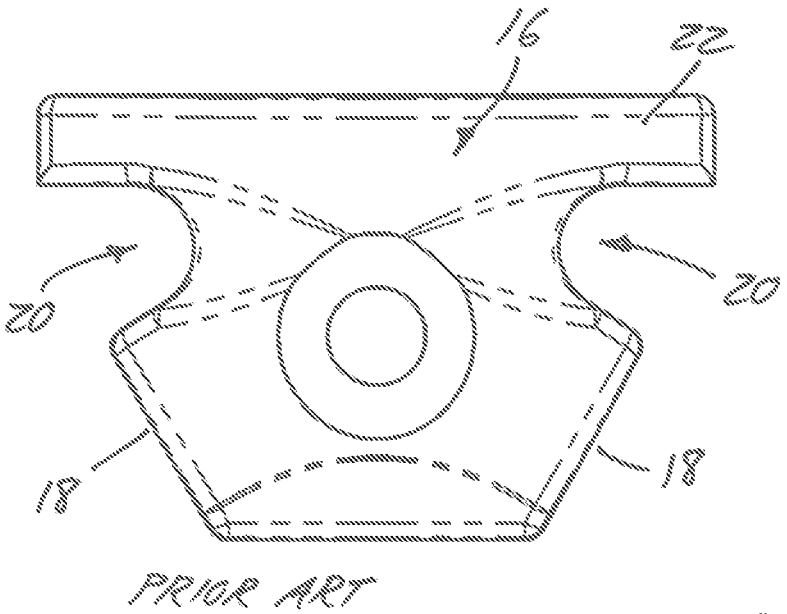
FIG. 2 is a front or rear elevational view of a prior art footwear heel insert that engages with the heel pins of a pin binding heel unit.

FIG. 1 shows the prior art use of a singular u-spring 10 whose two symmetrical halves embody two heel pins 12 in a manner utilized in lightweight pin binding heel units for many years. The two ends 14 of the u-spring 10 engage with the footwear heel fitting 16 shown in FIG. 2, and in order for the fitting 16 to engage the u-spring 10, the fitting must be forced downwards to bring the wedge defined by the two upwardly divergent entry ramps 18 of the footwear heel fitting 16 into contact with the u-spring heel pins 12, which allows the downward force exerted on the pins by the fitting 16 to flex the two pins 12 of the u-spring 10 away from one another. This permits the wide top end of the wedge of the heel fitting 16 to pass fully between the two pins 12 so that the two pins ride past this widest point at the top ends of the entry ramps 18 and into a pair of engagement notches 20 situated above the entry ramps 18 and beneath a head 22 of the fitting 16. In this engaged state of the heel pins 12 with the notches 20 of the heel fitting 16 of the footwear, the footwear heel is supported for skiing, and cannot move up or down unless a sufficient upward force is generated which allows the heel fitting 3 to flex the heel pins 12 apart and disengage from the notches 20 of the footwear heel fitting 16, allowing the footwear heel fitting to decouple from the u-spring 10. This disengagement most commonly occurs when the user falls forward and the disengagement is desirable to prevent injuries.

Figure 3:
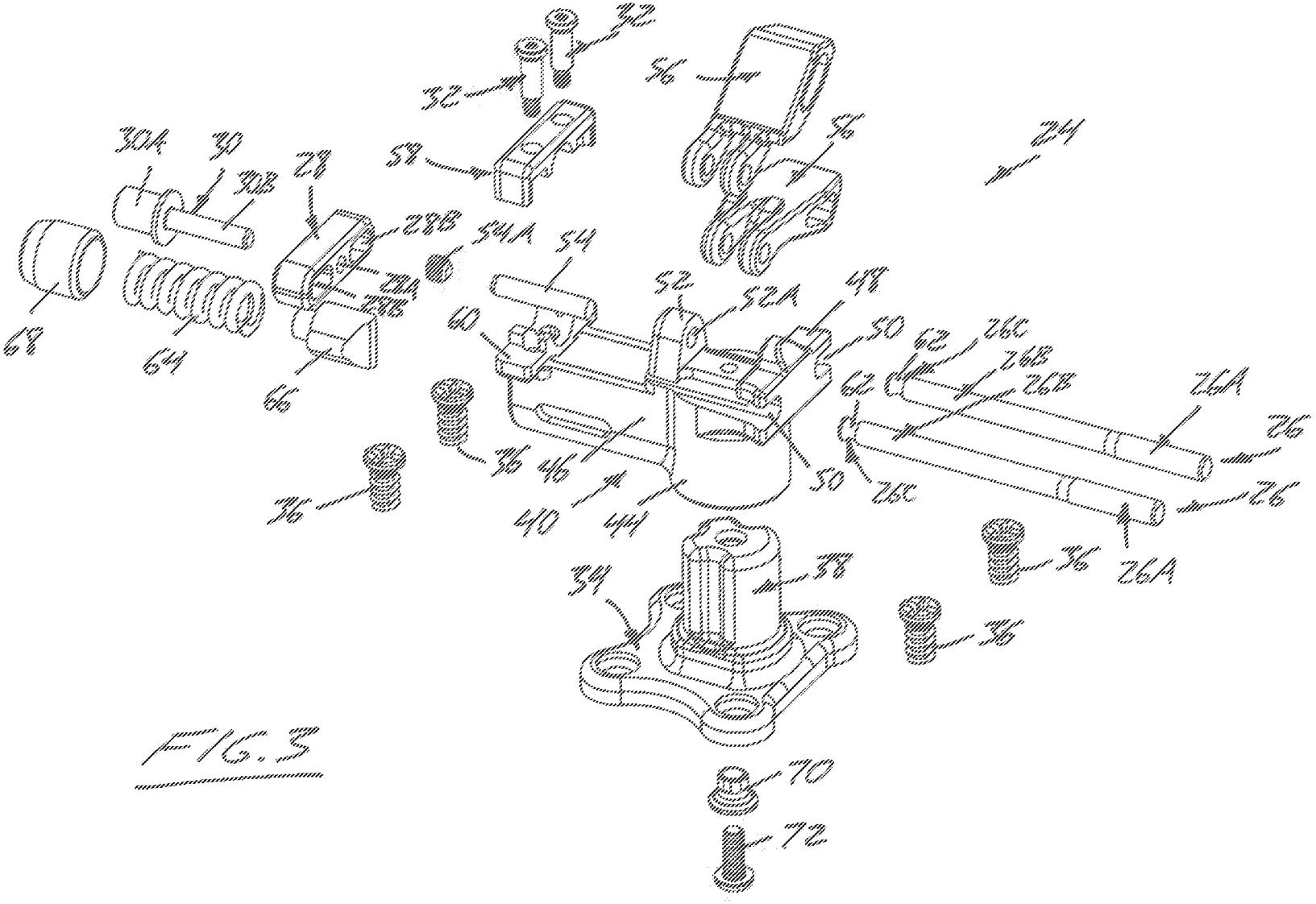
FIG. 3 is an exploded perspective view of a pin binding heel unit according to a preferred embodiment of the present invention.
Figure 4:
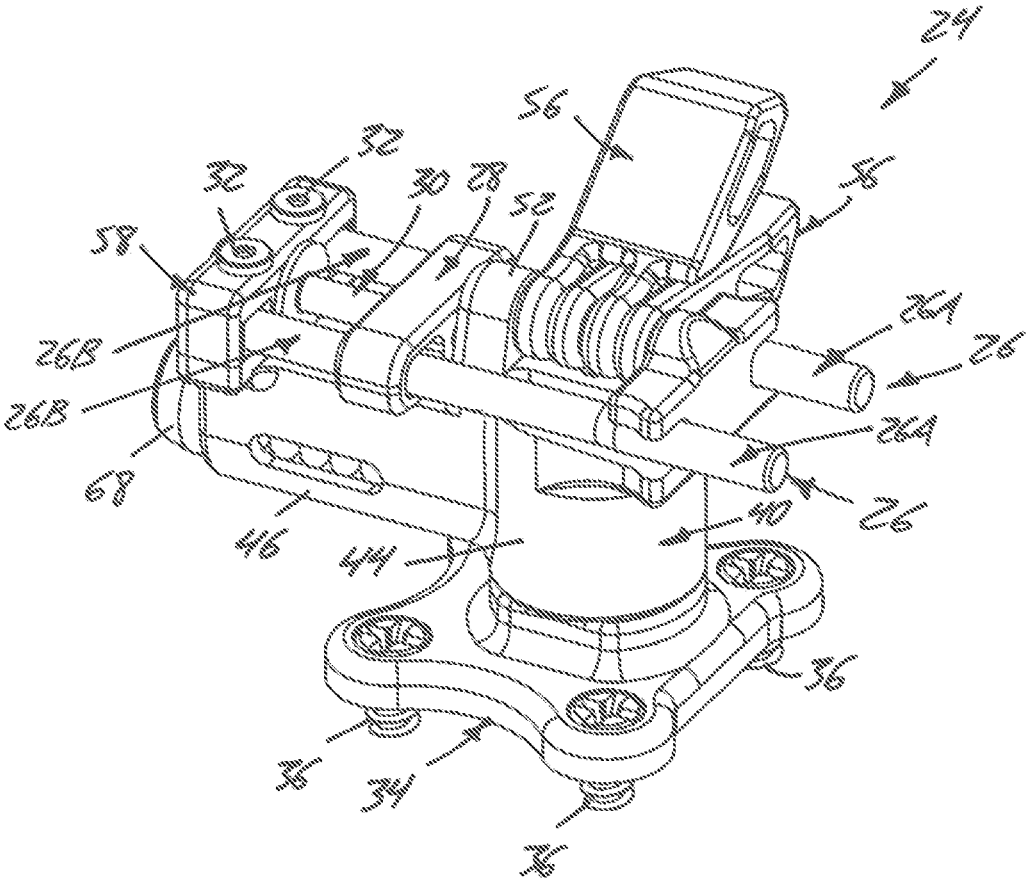
FIG. 4 is a front-side perspective view of the inventive heel unit.
Figure 5:
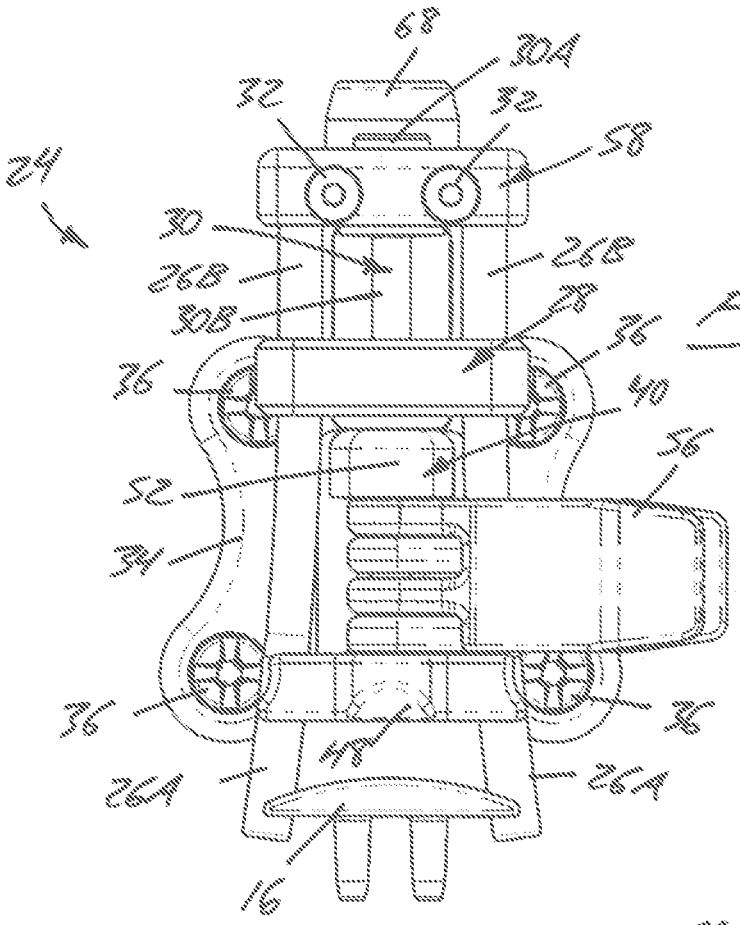
FIG. 5 is a top plan view of the inventive heel unit during lowered engagement of a footwear heel insert (shown in isolation from a ski boot, for illustrative clarity) into the heel unit, and illustrating flexure of the heel pins during said engagement.
Figure 6:
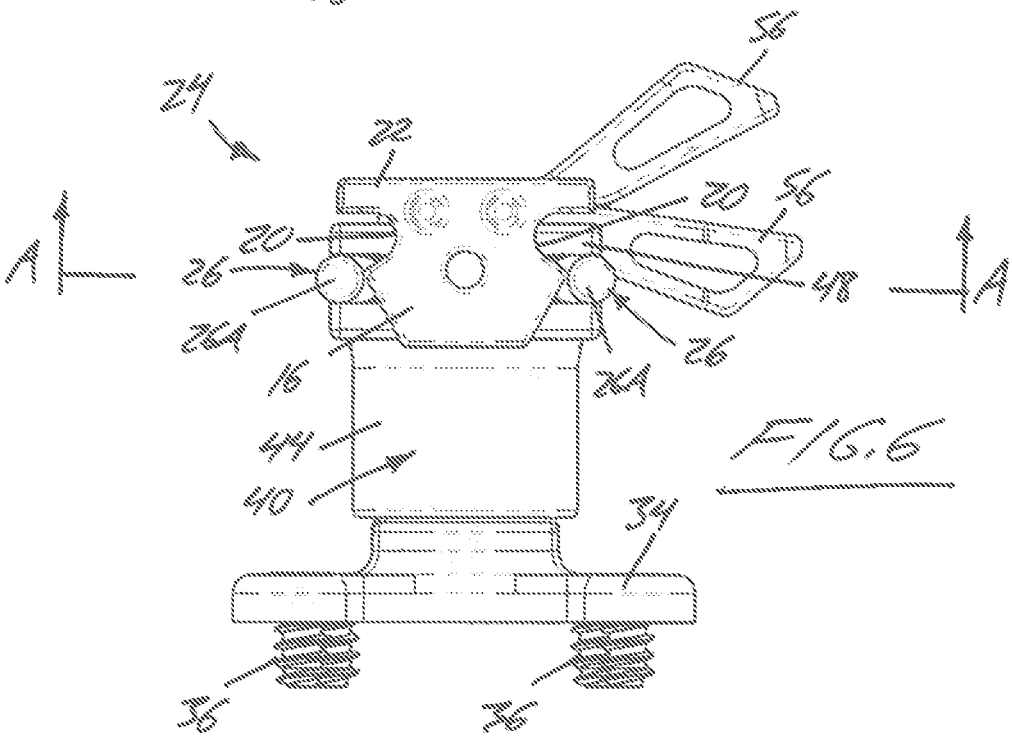
FIG. 6 is a front elevational view of the inventive heel unit and footwear heel insert of FIG. 5.

FIG. 3 shows an exploded view of the inventive heel unit 24 according to a preferred embodiment of the present invention, which exploded view reveals all component parts for this embodiment. In this heel unit 24, the traditional u-spring 10 is replaced with two separate flexible heel pins 26 of elongated linear shape and circular cross-section, a blocker 28, a blocker adjustment screw 30 and a pair of rear pivots 32. FIG. 4 shows the fully assembled binding in a perspective view. Similar to the integrally joined heel pins 12 of the prior art u-spring 10 the flexible separate heel pins 26 of the inventive heel unit 24 can be forced open in wedged fashion by the footwear heel fitting 16 to engage the binding, but the force required to spread the heel pins 26 is adjustable, and not fixed as it is in a traditional u-spring 10 implementation. FIGS. 5 & 6 show how the heel fitting 16 can be forced in-between protruding front regions 26A of the heel pins 26 from above to make these protruding front regions 26A of the heel pins 26 spread further apart from one another. Once the wide top end of the wedge of the heel fitting 16 is forced downwards just past the point shown in FIG. 5, the temporarily flexed apart front regions 26A of the heel pins 26 will close or relax back toward one another and settle in the engagement notches 20 of the heel fitting 16. The blocker 28 resists the outward spreading of the heel pins 26 at an adjustable position along lengthwise mid regions 26B thereof, while the rear pivots 32 resist laterally inward movement of the heel pins 26 at rear regions 26C thereof near the terminal rear ends of heel pins 5. When the position of the blocker 28 is shifted towards the rear of the heel unit 24 with the blocker adjustment screw 30, the spreading force required to flex the front regions 26A of the heel pins 26 further apart from one another is reduced, and conversely if the blocking element 28 is positioned further forward, then the amount of required spreading force is increased.

Figure 7:
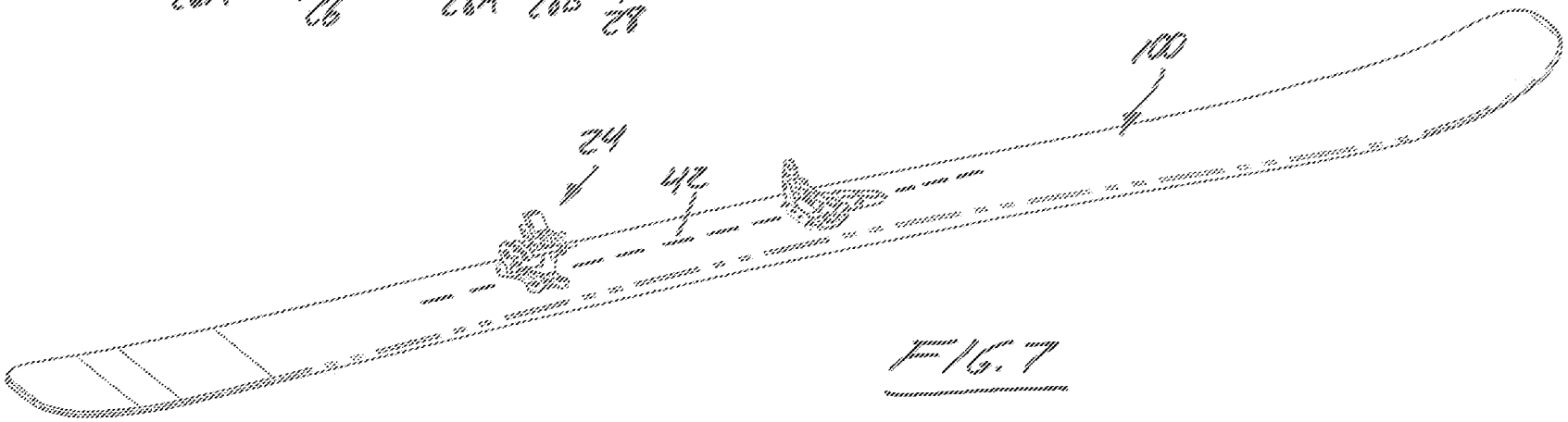
FIG. 7 is a rear side perspective view of a ski equipped with both the inventive heel unit and an accompanying toe unit to cooperatively form a fully functional pin binding of the ski.

In known fashion, the inventive heel unit 24 features a chassis 34 for flush placement atop a ski 100 and fastening of the heel unit hereto via mounting screws 36 tightenable through suitably located fastening holes of the chassis 34. A static heel post 38 stands vertically upright from the chassis 34 to accommodate mounting thereover of a heel body 40 that can be rotatably adjusted about a vertical axis of the heel post 38. Referring to FIG. 7 for directional reference, a longitudinal midline axis 42 of the ski 100 defines a longitudinal directionality, in which the terms front/fore and rear/aft are used herein to differentiate longitudinally opposing directions, and which longitudinal directionality also corresponds to the forward travel direction of the ski during use thereof. A directionality of perpendicularly transverse relation to the longitudinal directionality is referred to herein as a lateral directionality, in which the term inner and outer may be used to differentiate between relatively near and far lateral proximity to the longitudinal midline axis 42. Component geometry and relative component positions of the heel unit 24 is described herein in relation to the downhill mode of the heel unit 24 in which it is illustrated. In this downhill mode, the components are suitably positioned and oriented for engagement of the heel pins 26 with the heel fitting 16 of the ski boot or other similarly equipped footwear.

The heel body 40 has a lower front cylindrical hub 44 characterized by an internal cylindrical bore of downwardly open character by which the heel body is rotatably mountable over the heel post 38. A tail 46 of the heel body 40 radiates unidirectionally from the hub 44 in the rearward longitudinal direction. Situated atop the hub 44 and across from the tail 46 is a head 48 of the heel body 40 that spans laterally across the heel body 40 in tangential relation to the cylindrical shape of the hub 44. Laterally opposing sides of the head 48 are characterized by respective notches 50 of laterally open character, each of which cradles a respective one of the heel pins 26. From each notch 50, the front region 26A of the respective heel pin 26 projects forwardly past the head 50 to overhang from the front end of the heel body 40 in exposed fashion engageable by the footwear heel fitting 16. Also atop the hub 44, at a position diametrically across the from the head 50 and above the tail 46, the heel body 40 features a pivot lug 52 penetrated by a threaded longitudinal pivot bore 52A that aligns with a blind hole in rear face of the head 48 to accommodate cooperative support of a heel lift pivot 54 in the pivot bore 52A and aligned hole in the rear of the head 48. The heel lift pivot 54 thus spans longitudinally and diametrically across the hub 44 in elevated relation thereover. An externally threaded pivot retainer 54A is engaged in the threaded pivot bore 52A behind the heel lift pivot 54 to capture the heel pivot 54 in its installed position, thereby locking it to the heel body 40. A pair of heel lifts 56 are pivotally supported on the heel lift pivot 54 for pivotal movement thereabout. In touring mode, when the heel body is rotated 90-degrees from its illustrated downhill mode position, one or both heel lifts 56 can be situated in working positions overhanging forwardly from the heel post 38 (at the front position that is occupied by the overhanging front regions 26A of the heel pins 26 in the illustrated downhill mode). Here, the heel lifts 56 can be used by the skier to support the bottom of the footwear heel while climbing slopes. If not needed, one or both heel lifts can be flipped to a reversed non-working position to the rear of the heel post 38, thus out the way of the skier's footwear.

Restraint of the rear regions 26C of the heel pins 26 in a longitudinally and laterally fixed manner is achieved by the rear pivots 32 and a heel cap 58 that are cooperatively installed atop a rear mount 60 of the heel body 40 that resides at or near a rear end of the tail 46 furthest from the hub 44. The vertically oriented rear pivots 32 are threaded downwardly into threaded holes in the rear mount 60 through matching holes in the heel cap 58, whereby the rear pivots 32 perform double duty to both fasten the heel cap 58 in place and serve as bearing surfaces that restrain the rear regions of the heel pins 26 against laterally inward displacement, thus maintaining these rear regions of the heel pins at a fixed lateral distance from one another. The rear mount 60 and the heel cap 58 fastened thereto cooperatively form a pair of pin-receiving channels, each of which houses the rear region 26C of a respective one of the heel pins 26. The rear region 26C of each heel pin 26 is thereby vertically bound between the heel cap 58 and the underlying rear mount 60, and horizontally bound between an outer side of the channel (e.g. embodied by a downturned outer wall of the heel cap 58 in the illustrated example, or alternatively by an upturned outer wall of the rear mount 60 in an unillustrated variant) and the respective rear pivot 32 that resides at an opposing inner side of the channel. The rear pivots 32 and the cooperating heel cap 58 and rear mount 60 thus collectively form a rear heel pin holder by which the rear regions 26C of the heel pins 26 are held fixed against longitudinal, lateral and vertical displacement.

The rear region 26C of each heel pin 26 of the illustrated embodiment is characterized by a circumferential groove 62 of concavely rounded character, which groove is matched to the respective rear pivot 32, which in this embodiment is a pivot pin whose cylindrical profile has an outer arc thereof received in the rounded groove so that the rear pivot 32 restricts longitudinal movement of the heel pin 5 in the forward and rearward directions, but allows the heel pin 26 to spin about its longitudinal axis. As revealed in FIG. 6A, the outer channel walls of the heel cap 58 have rounded protuberances at the inner surfaces thereof that likewise mate with the rounded grooves 62 of the heel pins at positions diametrically across from the respective rear pivots in contribution to the restrained yet rotatable state of the two heel pins 26. Fitted over the heel pins 26, the heel cap 58 also restrains the rear ends of heel pins 26 in the vertical direction, blocking lifting thereof from off the rear mount 60 and out of the grooved engagement with the rear pivots 32. The rotatability of the heel pins 26 allows heel pins 26 to have a much longer service life than traditional u-spring bindings, since the heel pins 26 can roll about their axes when engaged by the heel fitting 16, as opposed to a non-rolling higher-friction sliding interface that would occur with a rotationally fixed u-spring 10 of the conventional prior art.

Figure 6A:
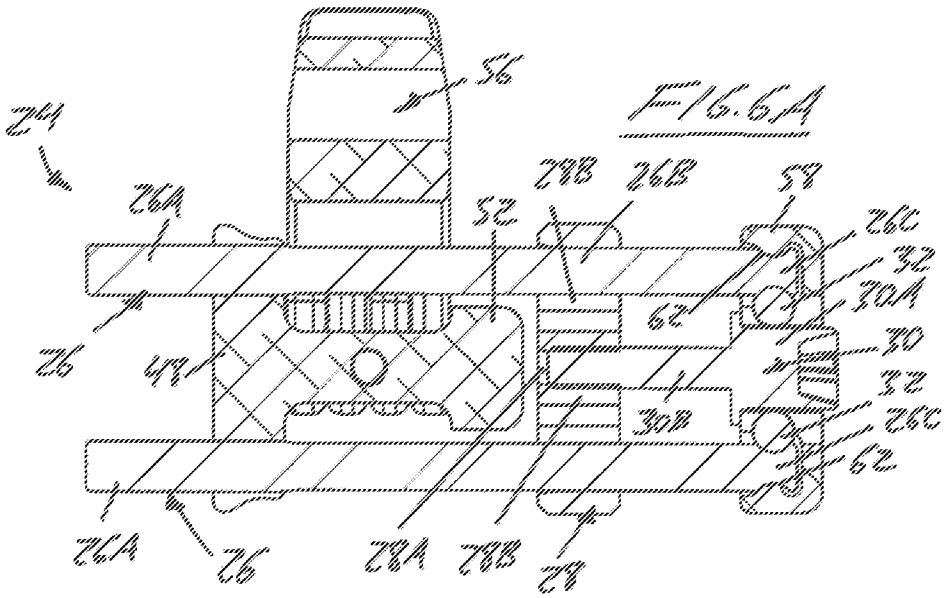
FIG. 6A is a cross-sectional view of the inventive heel unit of FIG. 6 as taken along line A-A thereof.

The heel pin blocker 28 lies laterally across the tail 46 of the heel body 40 at a position elevated thereover between the rear mount 60 and the pivot lug 52, and has a threaded center bore 28A penetrating longitudinally therethrough, and two pin channels 28B penetrating longitudinally therethrough on respective sides of the center bore 28A. The blocker adjustment screw 30 engages into the threaded center bore 28A of the heel pin blocker 28 through a rear center opening delimited between the heel cap 58 and rear mount 60 at a position between the two pin-receiving channels. An actuation head 30A of the adjustment screw 30 projects through, or is at least accessible in, the rear center opening, and a threaded shaft 30B of the adjustment screw 30 spans forwardly from the head 30A to the pivot lug 52 and has its threads engaged with those of the threaded center bore 28A of the heel pin blocker. User rotation of the adjustment screw 30 is operable to longitudinally advance and retreat the heel pin blocker 28 along the threaded shaft 30B of the adjustment screw 30 in the confined space between the pivot lug 52 and the heel cap 58, thereby adjusting the particular location along the heel pins 26 at which the heel pin blocker 28 encompasses the heel pins 26 and blocks the same against laterally outward deflection at an outside wall of each pin channel 28B. As best shown in FIG. 6A, each pin channel 28B is wider than the diameter of the heel pin 26 passing through the channel, thus leaving clearance space between the heel pin 26 an inner side of the channel, which accommodates laterally inward bowing of the mid regions 26B of heels pins at the blocker 28 during laterally outward spread of the front regions 26A of the heel pins. The closer the heel pin blocker 28 resides to the rear heel pin holder 32, 58, 60, the less resistance the heel pins 26 have to outward flexure at front regions 26A that project forwardly from the head 48 of the heel body in overhanging fashion at the front end of the heel unit 24. The further the heel pin blocker 28 resides from the rear heel pin holder 32, 58, 60, and thus the closer the heel pin blocker 28 resides to the pivot lug 52, hub 44 and heel post 38, the greater resistance the heel pins 26 have to outward flexure thereof at the projecting front regions 26A. The partial length of the heel pin 26 throughout which the heel pin blocker 28 is adjustable in position is referred to herein as a mid region 26B thereof, in that it is located intermediately of the projecting front region 28A and the grooved rear region 28C in the longitudinal direction.

In alternative to inclusion of a circumferential groove 62 in each heel pin 26 at the captured rear region 26C thereof to cooperate with a respective cylindrical rear pivot 32 in a manner blocking longitudinal displacement of the pin 26 while allowing rotation thereof via receipt of the cylindrical pivot profile in the rounded concavity of the groove 62, a variant of the illustrated embodiment could instead embody a spherical ball at the rear end of the heel pin 26 cooperating with a spherical socket inside the respective channel of the rear mount 60 and heel cap 58, in similar fashion to such ball tipped pins seen in aforementioned U.S. Pat. No. 10,463,946. The heel pin 5 diameter can also be varied along its length, as variation in the pin diameter will affect the spring characteristics of the pin and vary the degree of adjustment of that occurs during graduated advancement and retraction of the blocker back and forth along the pins. Pins with differential variable profiles can also be offered to provide different spreading force characteristics that allow different ranges of release values for skiers of different sizes. In this way we can turn a typical u-spring binding that's not adjustable or durable into a binding where the user doesn't have to make these compromises with adding very little weight by not requiring a coil spring.

A lateral release mechanism that's well known in the prior art can be implemented, and utilizes a lateral release spring 64, a lateral release plunger 66 and a lateral release adjuster 68, by which the heel pins 26 are biased, in the manner described in more detail below, towards a central position pointing forwardly and lying symmetrically of the ski's longitudinal midline axis 42. In this embodiment, the heel pins 26 themselves can resist loads in the lateral direction that arise from the skier twisting their leg about a vertical axis, and thus don't spread under such action, and it is the lateral release spring 64 that will instead give way under such instances. The lateral release components 64, 66, 68 are housed in the heel body 40, which as previously mentioned, is able to rotate about a vertical axis defined by the heel post 38. More particularly, in order of proximity to the heel post 38, the lateral release plunger 66, the lateral release spring 64 and the lateral release adjuster 68 are cooperatively installed within a longitudinally oriented internal bore of the tail 46 of the heel body 40, a front end of which bore opens horizontally into the vertically oriented internal bore of the hub 44. The heel body 40 is restrained vertically to the heel post 38 by a top hat spacer 70 and a heel body screw 72. A crown of the top hat spacer 70 is rotationally locked into the heel body 40 at the ceiling of the hub's internal bore, and the rim of the top hot spacer slides against a ceiling of a hollow interior of the post 38 so that the heel body screw 13 will not loosen. The heel post 38 has three detents of rounded camming profile in its periphery, situated at ninety degrees to one another around the vertical heel post axis, with one detent at the rear and two slots at laterally opposing sides. Spring biased engagement of the lateral release plunger 66 in the rear detent of the heel post 38 holds the heel body 40 in the illustrated downhill mode position, with the heel pins 26 protruding forwardly from the heel post 38 in a centered position. Lateral release adjuster 68 is threaded in the longitudinal bore of the tail 46 of the heel body 40, whereby rotation of the adjuster 68 is operable to adjust the pre-compression of the lateral release spring 64, and thereby control the lateral release force by which the heel body 40 is biased to the centered position by the cooperatively camming profiles of the post's rear detent and the mating plunger 66.

As mentioned above, the rear detent in the heel post 38 is accompanied by two side detents situated at ninety degrees from the rear detent, from which it will be appreciated that this embodiment is switchable to the touring mode by rotating the heel body 40 from its longitudinally oriented downhill mode position parallel to the longitudinal travel direction, as shown in the drawings, to either one of two possible touring mode positions each oriented perpendicular to the longitudinal travel direction. In either touring mode position, the plunger 66 is relocated to one of the side detents in the heel post 38, in which the spring biased plunger 66 achieves a relatively stable static or solid position. In such touring mode positions, the heel pins 26 point laterally outward from the heel post 38 at one side thereof instead of pointing forwardly therefrom, and one or both heel lifts 56 can be positioned about the heel lift pivot 54 into the working position at the front of the heel post 38 for optional use to support the bottom of the footwear heel while climbing slopes.

The chassis 34 of the heel post 38 can be mounted directly to a ski by the mounting screws 36, or indirectly into an adjustment plate to allow the heel unit position to be adjustable fore and aft of the ski 100 to fit different size footwear. It should be noted that the arrangement of components 26, 28 and 30 could be used with a binding of the type shown in U.S. Pat. No. 10,010,782, and instead of the heel pins 26 just biasing the forward falling release force, with separate reliance made on lateral release spring 64 to bias the lateral release force, the heel pins 26 could instead be reconfigured in a manner responsible for biasing both the forward falling and lateral release forces, in similar fashion to how the binding of U.S. Pat. No. 10,010,782 uses its u-spring 10 to control lateral release. This would be a significant improvement over the prior art, since it would have a single adjustment screw 30 for both release modes. This would mean that binding setup would be extremely quick, release loads would be appropriate for every user, and the heel pins 26 would be much more durable than a u-spring binding.

Figure 8:
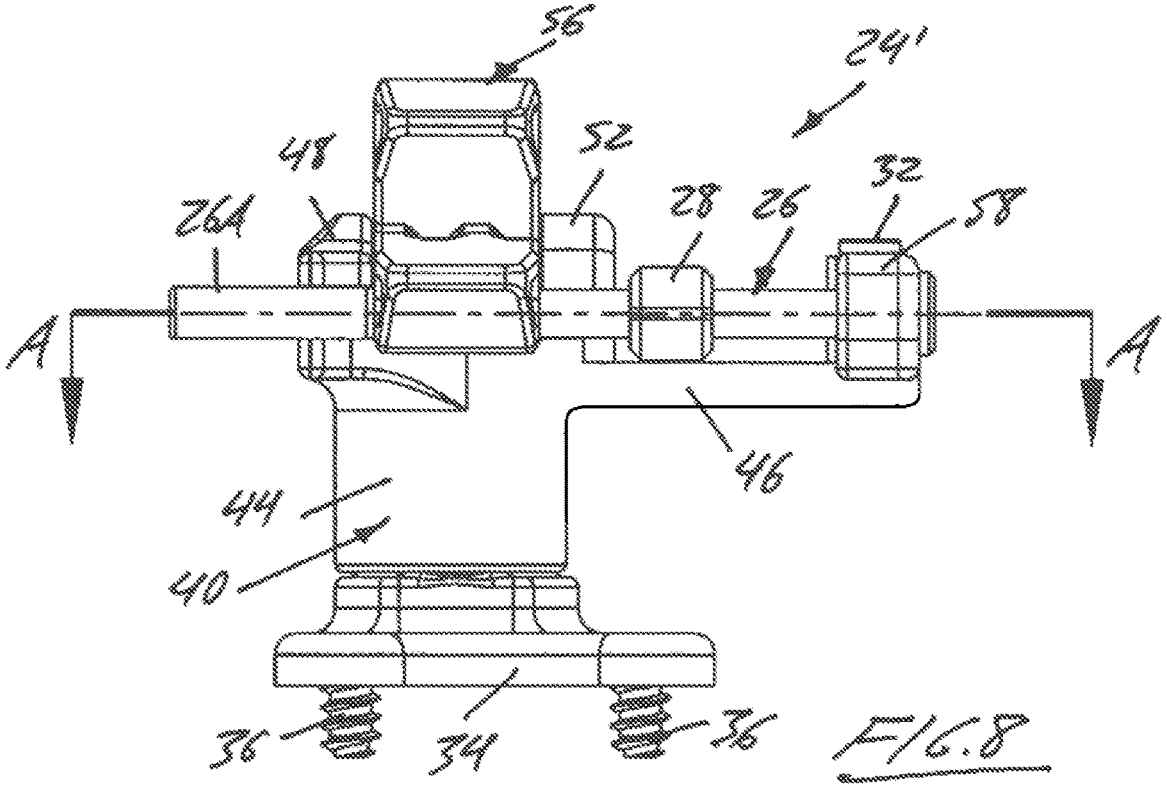
FIG. 8 is a side elevational view of an alternate embodiment of the inventive heel unit.
Figure 8A:
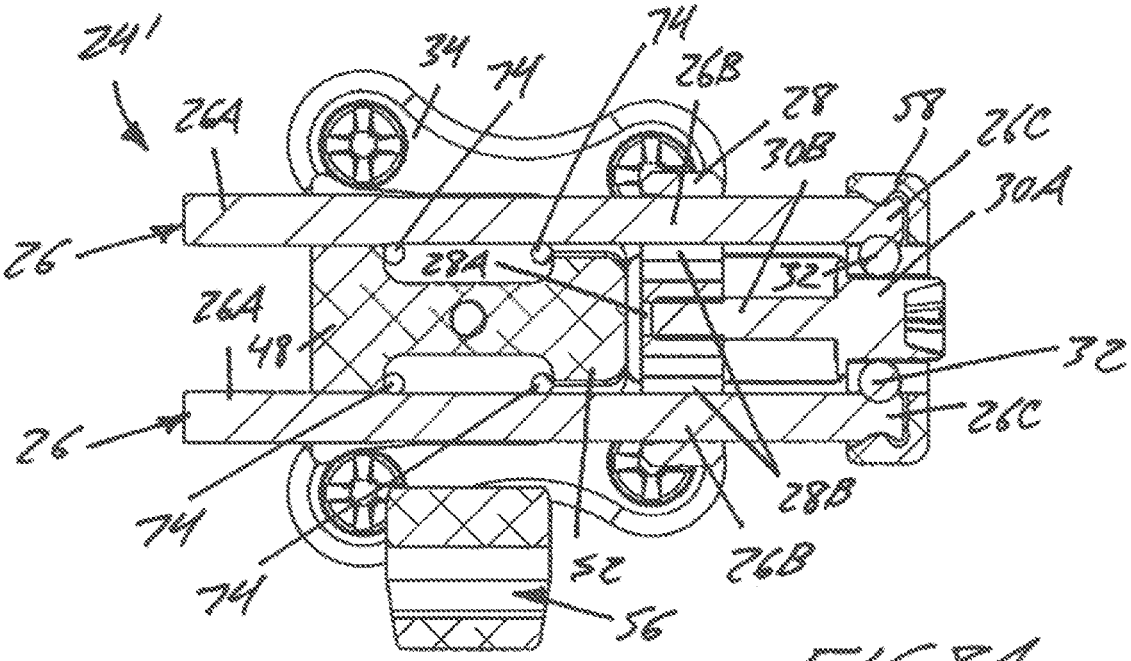
FIG. 8A is a cross-sectional view of the alternate embodiment of FIG. 8 as taken alone line A-A thereof.

One possible implementation of such an alternate embodiment of the heel unit 24' is schematically illustrated in FIGS. 8 and 8A, where the lateral release spring 64 and associated plunger 66 and adjuster 68 are rendered unnecessary and thus omitted. In this embodiment, four contact pins 74 stand vertically upright from the heel post 38 in static positions thereon and are tall enough to reach the elevation of the two heel pins 26 in the lateral space between the two heel pins above the heel post 38. The four contact pins 74 are arranged in two pairs, each pair residing on respective side of the longitudinal midline axis 42 in symmetric relation to the other pair, in positions such that each pair resides closely adjacent, or even abutting, relationship to the inner side of a respective one of the heel pins when the heel pins are in the illustrated centered position pointing longitudinally of the ski in symmetric relationship to one another on opposing sides of the longitudinal midline axis. Under rotation of the heel body 40 in either direction out of this centered position, a diagonally opposing two of the contact pins force laterally outward spread of the two heel pins 26 further away from one another in front of the blocker that prohibits such spread at the blocker's location further back on the heel pins. In this embodiment, the rotation of the heel body 40 from the centered position in a lateral release scenario is thus resisted by the effective spring stiffness (i.e. flexure resistance) of the heel pins 26, whose particular value is variable through adjustment of the blocker position. In this embodiment, if the lateral release spring 64 and associated plunger 66 and adjuster 68 are omitted, the adjustment screw 30 of the blocker 28 is therefore operable to adjust both the forward falling release force and the lateral release force. While the illustrated example uses four discretely separate contact pins 74 to form the contact surfaces against which heel pins ride during rotation of the heel body out of the centered position to force the spreading of the heel pins 26, these four contact surfaces may be embodied in any quantity of one or more contact bodies, whether pin-shaped or otherwise, and so general reference to a set of contacts can refer to a plurality of separate contact bodies (e.g. pins) each embodying one such contact, or as few as a singular contact bodies, of which differently positioned and oriented surfaces or features embody this plural set of contacts.

While principles of the present disclosure are described herein with reference to illustrative aspects for particular applications, the disclosure is not limited thereto. Those having ordinary skill in the art and access to the teachings provided herein will recognize additional modifications, applications, aspects, and substitution of equivalents all fall in the scope of the aspects described herein. Accordingly, the present disclosure is not to be considered as limited by the foregoing description.

The invention claimed is:

1. A heel unit apparatus for a ski touring binding, the apparatus comprising:

a heel body;

two separate heel pins supported on said heel body in positions projecting forwardly from a front end of said heel body in positions of laterally spaced relation to one another, each one of said two separate heel pins having respective front and rear terminal ends of opposing relationship in lengthwise relation to the two separate heel pins;

a heel pin blocker engaging the two separate heel pins at an adjustable location within lengthwise mid regions of the two separate heel pins in a manner blocking laterally outward spreading of the two separate heel pins at said location;

a blocker adjustment operable to vary said adjustable location at which said heel pin blocker engages the two separate heel pins, and to hold the heel pin blocker static at said adjustable location, once set; and a rear heel pin holder by which the two separate heel pins, at rear regions thereof adjacent the respective rear ends of the two separate, are:

held fixed against longitudinal movement of either of the two separate heel pins;

held fixed against lateral displacement of either of the two separate heel pins;

held at a fixed lateral distance from one another; and allowed to spin about respective longitudinal axes of the two separate heel pin;

whereby, owing to lateral fixation and blocking of the two separate heel pins at both the rear and intermediate regions thereof, laterally outward spreading of the two separate heel pins at front regions thereof situated in front of the heel body during forced insertion of a footwear heel between said two separate heel pins for engagement thereby, and during safety release of the footwear heel therefrom, is achieved purely by temporary flexure of the two separate heel pins themselves, and closure of the front regions of the two separate heel pins back toward one another is effected purely by self-relaxation of the temporary flexure thereof.

2. The apparatus of claim 1, wherein the rear heel pin holder comprises a pair of rear pivots respectively fixing the two separate heel pins against said longitudinal movement and lateral displacement.

3. The apparatus of claim 2, wherein the two separate heel pins, at the rear regions thereof, comprise rounded features at which the two separate heel pins are longitudinally and laterally fixed by said rear pivots, yet allowed to spin about the respective longitudinal axes of said two separate heel pins.

4. The apparatus of claim 3 wherein said rounded features comprises rounded grooves spanning circumferentially around the two separate heel pins, and the rear pivots comprise cylindrical pivot pins whose cylindrical profiles mate with said rounded grooves.

5. The apparatus of claim 1 wherein the heel body comprises a hub fitted over a heel post about which the heel body is rotatable, and a tail radiating outward from said hub on which the rear heel pin holder is embodied at a distance from said hub, and the heel pin blocker resides overtop of the tail between said rear heel pin holder and said hub.

6. The heel unit apparatus of claim 1 wherein each of the two separate heel pins passes through a pin channel in the heel pin blocker, and said pin channel is wider than a diameter of each of the two separate heel pins and includes an unoccupied clearance space situated on an inner side of the heel pin to accommodate laterally inward bowing thereof during said temporary flexure.

7. The heel unit apparatus of claim 1 wherein the two separate heel pins pass through two respective pin channels in the heel pin blocker, and each of said two respective channels is wider than a diameter of each of the two separate heel pins and includes an unoccupied clearance space situated on an inner side of a respective one of the two heel pins to accommodate laterally inward bowing thereof during said temporary flexure.

8. A heel unit apparatus for a ski touring binding, the apparatus comprising:

a heel post;

a heel body rotatable about said heel post;

two heel pins supported on said heel body in positions projecting forwardly from a front end of said heel body in positions of laterally spaced relation to one another;

a heel pin blocker engaging the two heel pins at an adjustable location within lengthwise mid regions of the two heel pins in a manner restraining laterally outward spreading of the heel pins at said location;

a blocker adjustment operable to vary said adjustable location at which said heel pin blocker engages the two heel pins to adjust an effective spring stiffness of said two heel pins;

a set of contacts supported on the heel post in static relation thereto in positions that reside between the two heel pins and impart and outward spreading action thereto under rotation of the heel body in either direction out of a centered position in which the heel pins point longitudinally forward;

whereby the effective spring stiffness imparted to the two heel pins according to the adjustable location of the blocker controls both a forward falling release force required to spread the heel pins apart in the centered position, and a lateral release force required to rotate the heel body out of the centered position.

9. The heel unit apparatus of claim 8 wherein said set of contacts comprise a plurality of upright contact pins.

10. The heel unit apparatus of claim 8 wherein said set of contact comprises four contacts, arranged in two symmetric pairs each of which resides respectively adjacent to one of the heel pins in the centered position of the heel body.

* * * * *